US010356546B2

(12) United States Patent
Murata et al.

(10) Patent No.: US 10,356,546 B2
(45) Date of Patent: Jul. 16, 2019

(54) FILTER GENERATION DEVICE, FILTER GENERATION METHOD, AND SOUND LOCALIZATION METHOD

(71) Applicant: JVC KENWOOD Corporation, Yokohama-shi, Kanagawa (JP)

(72) Inventors: Hisako Murata, Yokohama (JP); Masaya Konishi, Yokohama (JP); Yumi Fujii, Yokohama (JP)

(73) Assignee: JVC KENWOOD CORPORATION, Kanagawa (JP)

( * ) Notice: Subject to any disclaimer, the term of this patent is extended or adjusted under 35 U.S.C. 154(b) by 0 days.

(21) Appl. No.: 16/052,243

(22) Filed: Aug. 1, 2018

(65) Prior Publication Data

US 2018/0343535 A1 Nov. 29, 2018

Related U.S. Application Data

(63) Continuation of application No. PCT/JP2016/004888, filed on Nov. 15, 2016.

(30) Foreign Application Priority Data

Feb. 4, 2016 (JP) ..... 2016-019906

(51) Int. Cl.

| | |
|---|---|
| ***H04S 7/00*** | (2006.01) |
| ***H04S 1/00*** | (2006.01) |
| ***H04S 3/00*** | (2006.01) |

(52) U.S. Cl.

CPC ..... *H04S 7/304* (2013.01); *H04S 1/00* (2013.01); *H04S 3/004* (2013.01); *H04S 2400/01* (2013.01); *H04S 2420/01* (2013.01)

(58) Field of Classification Search

CPC . H04S 7/00; H04S 7/301; H04S 7/302; H04S 7/303; H04S 7/304; H04S 1/00;

(Continued)

(56) References Cited

U.S. PATENT DOCUMENTS 4,143,244 A 3/1979 Iwahara et al.
6,466,913 B1 * 10/2002 Yasuda ..... G10L 21/00 704/270

(Continued)

FOREIGN PATENT DOCUMENTS

JP 2008-512015 A 4/2008

*Primary Examiner* — Jason R Kurr
(74) *Attorney, Agent, or Firm* — Procopio, Cory, Hargreaves & Savitch LLP

(57) ABSTRACT

A filter generation device includes left and right speakers, left and right microphones, and a processor that generates filters in accordance with transfer characteristics from the left and right speakers to the left and right microphones based on sound pickup signals. The processor includes a direct sound arrival time search unit that searches for a direct sound arrival time by using a time at which an absolute value of an amplitude reaches its maximum, a left and right direct sound determination unit that determines whether signs of amplitudes at the direct sound arrival time match, an error correction unit that, when the signs do not match, corrects cutout timing so that the direct sound arrival times coincide, and a waveform cutout unit that cuts out the transfer characteristics.

11 Claims, 15 Drawing Sheets

(58) Field of Classification Search
CPC ..... H04S 1/005; H04S 3/004; H04S 2400/01; H04S 2420/01
See application file for complete search history.

(56) References Cited

U.S. PATENT DOCUMENTS

| | | | | |
|---|---|---|---|---|
| 10,068,586 | B2 * | 9/2018 | Braasch | H04R 25/552 |
| 2006/0045294 | A1 | 3/2006 | Smyth | |
| 2010/0322428 | A1 * | 12/2010 | Fukui | H04S 7/30 381/17 |
| 2011/0305358 | A1 * | 12/2011 | Nishio | H04S 7/305 381/303 |

* cited by examiner

FILTER GENERATION DEVICE, FILTER GENERATION METHOD, AND SOUND LOCALIZATION METHOD

CROSS REFERENCE TO RELATED APPLICATION

This application is a Continuation of International Application No. PCT/JP2016/004888, filed on Nov. 15, 2016, and is based upon and claims the benefit of priority from Japanese patent application No. 2016-019906, filed on Feb. 4, 2016, the disclosure of which is incorporated herein in its entirety by reference.

BACKGROUND

The present invention relates to a filter generation device, a filter generation method, and a sound localization method.

Sound localization techniques include an out-of-head localization technique, which localizes sound images outside the head of a listener by using headphones. The out-of-head localization technique localizes sound images outside the head by canceling characteristics from the headphones to the ears and giving four characteristics from stereo speakers to the ears.

In out-of-head localization reproduction, measurement signals (impulse sounds etc.) that are output from 2-channel (which is referred to hereinafter as "ch") speakers are recorded by microphones placed on the listener's ears. Then, a head-related transfer function is calculated based on impulse response, and a filter is generated. The generated filter is convolved to 2-ch audio signals, thereby implementing out-of-head localization reproduction.

Patent Literature 1 (Published Japanese Translation of PCT International Publication for Patent Application, No. 2008-512015) discloses a method for acquiring a set of personalized room impulse responses. In Patent Literature 1, microphones are placed near the ears of a listener. Then, the left and right microphones record impulse sounds when driving speakers.

SUMMARY

Measurement has been carried out by using a special measurement room in which a sound source such as speakers is placed and using special equipment. However, with an increase in memory capacity and operation speed in recent years, it has become possible for a listener to carry out impulse response measurement by using a personal computer (PC) or the like. In the case where a listener carries out impulse response measurement by using a PC or the like, the following problems can occur.

In order to generate an appropriate filter for reproducing sound fields with a good balance between left and right, it is necessary to cut out left and right transfer characteristics at the coincidence timing. Impulse sounds from left and right speakers are respectively measured by left and right microphones, and transfer characteristics are acquired. Then, the left and right transfer characteristics are cut out with the same filter length at the same time, thereby calculating a filter coefficient.

When using general-purpose equipment such as a PC as an acoustic device, the amount of delay in the acoustic device varies from measurement to measurement. This is the same when an acoustic device where input and output are synchronized is connected to general-purpose equipment such as a PC. Specifically, the time from when measurement starts to when sounds reach microphones can differ between measurement using a left speaker and measurement using a right speaker. This makes cutout at the same timing difficult.

Further, when an environment where measurement is carried out is home of a listener or the like, the measurement environment can be asymmetric. For example, the room shape can be asymmetric, or the furniture layout can be asymmetric. Further, when a listener carries out measurement by using a PC or the like, a display, PC main body or the like can be placed near the listener. Furthermore, when microphones are placed on the ears of a listener, signal waveforms can be largely different in transfer characteristics due to a difference in auricle shape between left and right. Specifically, the waveforms of left and right transfer characteristics are largely different, which makes it difficult to cut out the left and right transfer characteristics at the coincidence timing. Thus, there is a possibility that a filter cannot be generated appropriately, and sound fields with a good balance between left and right cannot be obtained.

The present embodiment has been accomplished to solve the above problems and an object of the present invention is thus to provide a filter generation device, a filter generation method, and a sound localization method that are capable of generating an appropriate filter.

A filter generation device according to one aspect of the present invention includes left and right speakers, left and right microphones configured to pick up measurement signals output from the left and right speakers, and acquire sound pickup signals, and a filter generation unit configured to generate a filter in accordance with transfer characteristics from the left and right speakers to the left and right microphones based on the sound pickup signals, wherein the filter generation unit includes a search unit configured to search for a direct sound arrival time by using a time at which an absolute value of an amplitude reaches its maximum in each of first transfer characteristics from the left speaker to the left microphone and second transfer characteristics from the right speaker to the right microphone, a determination unit configured to determine whether signs of amplitudes of the first and second transfer characteristics at the direct sound arrival time match, a correction unit configured to correct cutout timing of the first transfer characteristics or the second transfer characteristics when the signs of the amplitudes of the first and second transfer characteristics at the direct sound arrival time do not match, and a cutout unit configured to cut out the first transfer characteristics or the second transfer characteristics at the cutout timing corrected by the correction unit, and thereby generate the filter.

A filter generation method according to one aspect of the present invention is a filter generation method that generates a filter by using transfer characteristics between left and right speakers and left and right microphones, the method including a search step of searching for a direct sound arrival time by using a time at which an absolute value of an amplitude reaches its maximum in each of first transfer characteristics from the left speaker to the left microphone and second transfer characteristics from the right speaker to the right microphone, a determination step of determining whether signs of amplitudes of the first and second transfer characteristics at the direct sound arrival time match, a correction step of correcting cutout timing of the first transfer characteristics or the second transfer characteristics when the signs of the amplitudes of the first and second transfer characteristics at the direct sound arrival time do not match, and a step of cutting out the first transfer characteristics or the second transfer characteristics at the corrected cutout timing and thereby generating the filter.

According to the embodiment, it is possible to provide a filter generation device, a filter generation method, and a sound localization method that are capable of generating an appropriate filter.

DETAILED DESCRIPTION

The overview of a sound localization process using a filter generated by a filter generation device according to an embodiment is described hereinafter. An out-of-head localization process, which is an example of a sound localization device, is described in the following example. The out-of-head localization process according to this embodiment performs out-of-head localization by using personal spatial acoustic transfer characteristics (which is also called a spatial acoustic transfer function) and ear canal transfer characteristics (which is also called an ear canal transfer function). In this embodiment, out-of-head localization is achieved by using the spatial acoustic transfer characteristics from speakers to a listener's ears and the ear canal transfer characteristics when headphones are worn.

In this embodiment, the ear canal transfer characteristics, which are characteristics from a headphone speaker unit to the entrance of the ear canal when headphones are worn are used. By carrying out convolution with use of the inverse characteristics of the ear canal transfer characteristics (which are also called an ear canal correction function), it is possible to cancel the ear canal transfer characteristics.

An out-of-head localization device according to this embodiment is an information processor such as a personal computer, a smart phone, a tablet PC or the like, and it includes a processing means such as a processor, a storage means such as a memory or a hard disk, a display means such as a liquid crystal monitor, an input means such as a touch panel, a button, a keyboard and a mouse, and an output means with headphones or earphones.

First Embodiment

Figure 1:
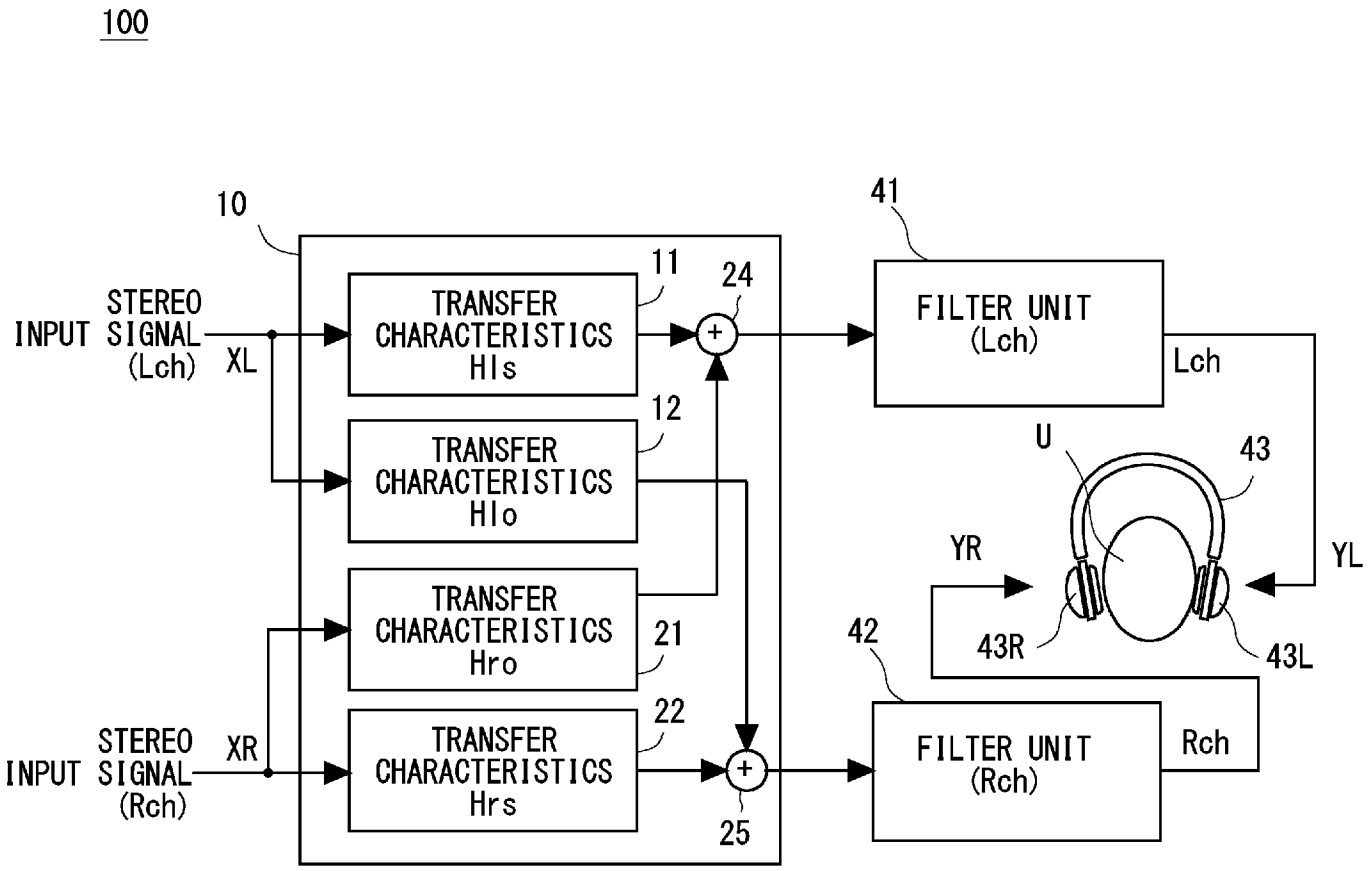
FIG. 1 is a block diagram showing an out-of-head localization device according to an embodiment.

FIG. 1 shows an out-of-head localization device 100, which is an example of a sound field reproduction device according to this embodiment. FIG. 1 is a block diagram of the out-of-head localization device. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are audio reproduction signals that are output from a CD (Compact Disc) player or the like. Note that the out-of-head localization device 100 is not limited to a physically single device, and a part of processing may be performed in a different device. For example, a part of processing may be performed by a personal computer or the like, and the rest of processing may be performed by a DSP (Digital Signal Processor) included in the headphones 43 or the like.

The out-of-head localization device 100 includes an out-of-head localization unit 10, a filter unit 41, a filter unit 42, and headphones 43.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves the spatial acoustic transfer characteristics into each of the stereo input signals XL and XR having the respective channels. The spatial acoustic transfer characteristics may be a head-related transfer function (HRTF) measured in the head or auricle of the user U, or may be the head-related transfer function of a dummy head or a third person. Those transfer characteristics may be measured on sight, or may be prepared in advance.

The spatial acoustic transfer characteristics include four transfer characteristics Hls, Hlo, Hro and Hrs. The four transfer characteristics can be calculated by using a filter generation device, which is described later.

The convolution calculation unit 11 convolves the transfer characteristics Hls to the L-ch stereo input signal XL. The convolution calculation unit 11 outputs convolution calculation data to the adder 24. The convolution calculation unit 21 convolves the transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves the transfer characteristics Hlo to the L-ch stereo input signal XL. The convolution calculation unit 12 outputs convolution calculation data to the adder 25. The convolution calculation unit 22 convolves the transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels the ear canal transfer characteristics is set to the filter units 41 and 42. Then, the inverse filter is convolved to the reproduced signals on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels the characteristics from a headphone unit to microphones when the headphones 43 are worn. Specifically, when microphones are placed at the entrance of the ear canal, the transfer characteristics between the entrance of the ear canal of a user and a reproduction unit of headphones or between the eardrum and a reproduction unit of headphones are cancelled. The inverse filter may be calculated from a result of measuring the ear canal transfer function in the auricle of the user U on sight, or the inverse filter of headphone characteristics calculated from an arbitrary ear canal transfer function of a dummy head or the like may be prepared in advance.

The filter unit 41 outputs the corrected L-ch signal to a left unit 43L of the headphones 43. The filter unit 42 outputs the corrected R-ch signal to a right unit 43R of the headphones 43. The user U is wearing the headphones 43. The headphones 43 output the L-ch signal and the R-ch signal toward the user U. It is thereby possible to reproduce the sound image that is localized outside the head of the user U.

(Filter Generation Device)

Figure 2:
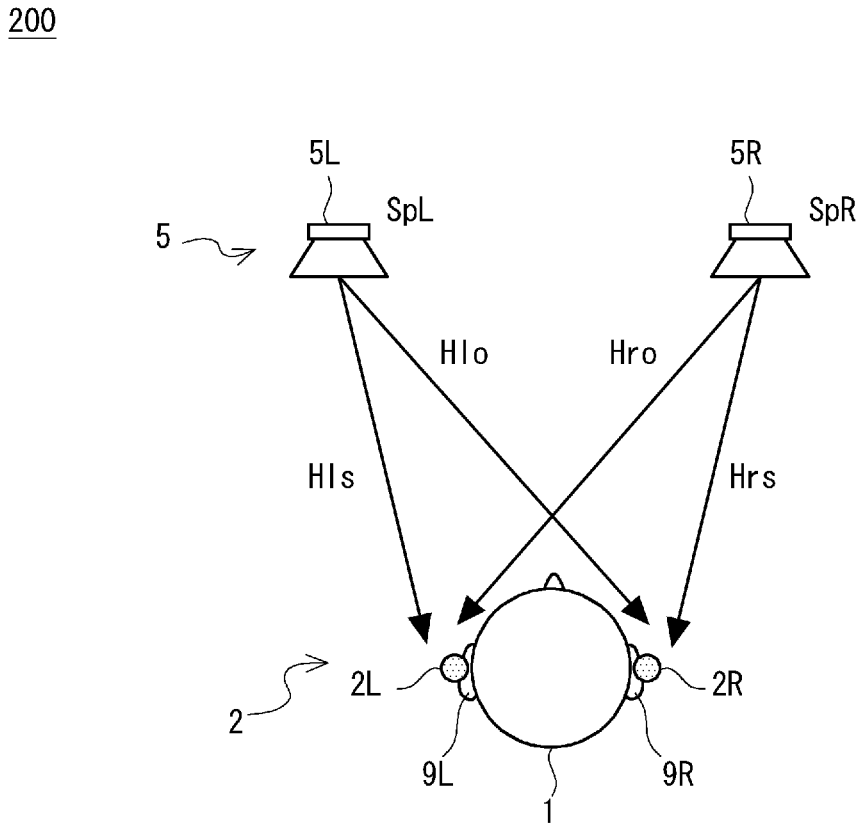
FIG. 2 is a view showing the structure of a filter generation device that generates a filter.

A filter generation device that measures spatial acoustic transfer characteristics (which are referred to hereinafter as transfer characteristics) and generates a filter is described hereinafter with reference to FIG. 2. FIG. 2 is a view schematically showing the measurement structure of a filter generation device 200. Note that the filter generation device 200 may be a common device to the out-of-head localization device 100 shown in FIG. 1. Alternatively, a part or the whole of the filter generation device 200 may be a different device from the out-of-head localization device 100.

As shown in FIG. 2, the filter generation device 200 includes stereo speakers 5 and stereo microphones 2. The stereo speakers 5 are placed in a measurement environment. The measurement environment is an environment where acoustic characteristics are not taken into consideration (for example, the shape of a room is asymmetric etc.) or an environment where environmental sounds, which are noise, are heard. To be more specific, the measurement environment may be the user U's room at home, a dealer or showroom of an audio system or the like. Further, there is a case where the measurement environment has a layout where acoustic characteristics are not taken into consideration. In a room at home, there is a case where furniture and the like are arranged asymmetrically. There is also a case where speakers are not arranged symmetrically with respect to a room. Further, there is a case where unwanted echoes occur due to reflection off a window, wall surface, floor surface and ceiling surface. In this embodiment, processing for measuring appropriate transfer characteristics even under the measurement environment which is not ideal is performed.

In this embodiment, a processor (not shown in FIG. 2) of the filter generation device 200 performs processing for measuring appropriate transfer characteristics. The processor is a personal computer (PC), a tablet terminal, a smart phone or the like, for example.

The stereo speakers 5 includes a left speaker 5L and a right speaker 5R. For example, the left speaker 5L and the right speaker 5R are placed in front of a listener 1. The left speaker 5L and the right speaker 5R output impulse sounds for impulse response measurement and the like.

The stereo microphones 2 include a left microphone 2L and a right microphone 2R. The left microphone 2L is placed on a left ear 9L of the listener 1, and the right microphone 2R is placed on a right ear 9R of the listener 1. To be specific, the microphones 2L and 2R are preferably placed at the entrance of the ear canal or at the eardrum of the left ear 9L and the right ear 9R, respectively. The microphones 2L and 2R pick up measurement signals output from the stereo speakers 5 and acquire sound pickup signals. The microphones 2L and 2R output the sound pickup signals to the filter generation device, which is described later. The listener 1 may be a person or a dummy head. In other words, in this embodiment, the listener 1 is a concept that includes not only a person but also a dummy head.

As a result that the impulse sounds that are output from the left and right speakers 5L and 5R are respectively measured by the microphones 2L and 2R as described above, impulse responses are measured. The filter generation device stores the sound pickup signals acquired based on the impulse response measurement into a memory or the like. The transfer characteristics Hls between the left speaker 5L and the left microphone 2L, the transfer characteristics Hlo between the left speaker 5L and the right microphone 2R, the transfer characteristics Hro between the right speaker 5R and the left microphone 2L, and the transfer characteristics Hrs between the right speaker 5R and the right microphone 2R are thereby measured. Specifically, the left microphone 2L picks up the measurement signal that is output from the left speaker 5L, and thereby the transfer characteristics Hls are acquired. The right microphone 2R picks up the measurement signal that is output from the left speaker 5L, and thereby the transfer characteristics Hlo are acquired. The left microphone 2L picks up the measurement signal that is output from the right speaker 5R, and thereby the transfer characteristics Hro are acquired. The right microphone 2R picks up the measurement signal that is output from the right speaker 5R, and thereby the transfer characteristics Hrs are acquired.

Then, the filter generation device generates filters in accordance with the transfer characteristics Hls to Hrs from the left and right speakers 5L and 5R to the left and right microphones 2L and 2R based on the sound pickup signals. To be specific, the filter generation device 200 cuts out the transfer characteristics Hls to Hrs with a specified filter length and generates them as filters to be used for the convolution calculation of the out-of-head localization unit 10. As shown in FIG. 1, the out-of-head localization device 100 performs out-of-head localization by using the transfer characteristics Hls to Hrs between the left and right speakers 5L and 5R and the left and right microphones 2L and 2R. Specifically, the out-of-head localization is performed by convolving the transfer characteristics to the audio reproduced signals.

A problem that arises when measuring the transfer characteristics under various measurement environments is described hereinafter. First, the signal waveforms of sound pickup signals when carrying out impulse response measurement in an ideal measurement environment are shown as a measurement example 1 in FIGS. 3 and 4. Note that, in the signal waveforms in FIGS. 3 and 4 and the figures described below, the horizontal axis indicates the sample number, and the vertical axis indicates the amplitude. Note that the sample number corresponds to the time from the start of measurement, and the measurement start timing is 0. The amplitude corresponds to the signal strength of the sound pickup signals acquired by the microphones 2L and 2R, or the sound pressure, which has a positive or negative sign.

In the measurement example 1, a rigid sphere as a model for a human head is placed in an anechoic room with no echo, and measurement is carried out. In the anechoic room as the measurement environment, the left and right speakers 5L and 5R are arranged symmetrically in front of the rigid sphere. Further, the microphones are placed symmetrically with respect to the rigid sphere.

Figure 3:
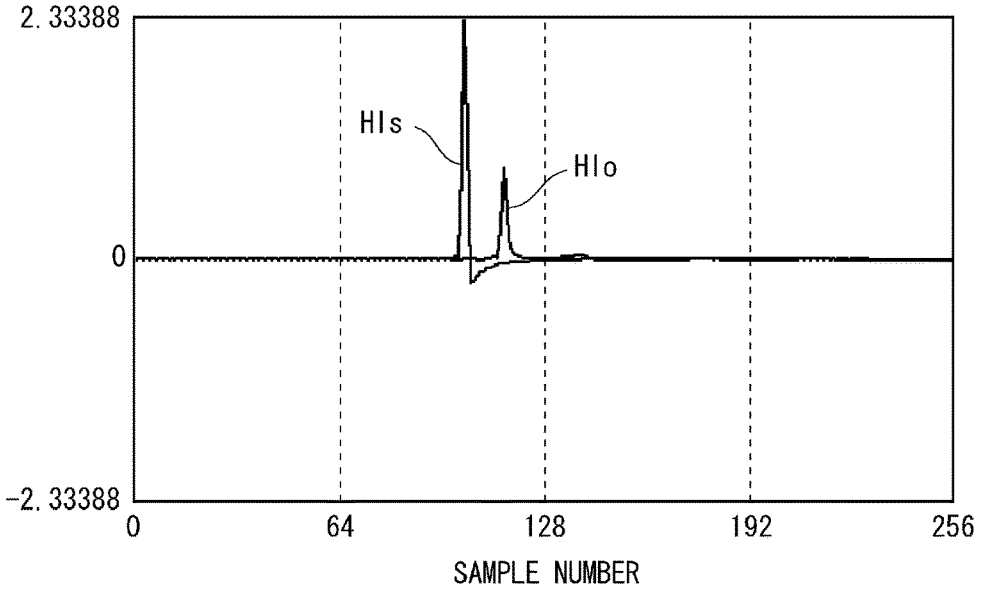
FIG. 3 is a view showing transfer characteristics Hls and Hlo in a measurement example 1.
Figure 4:
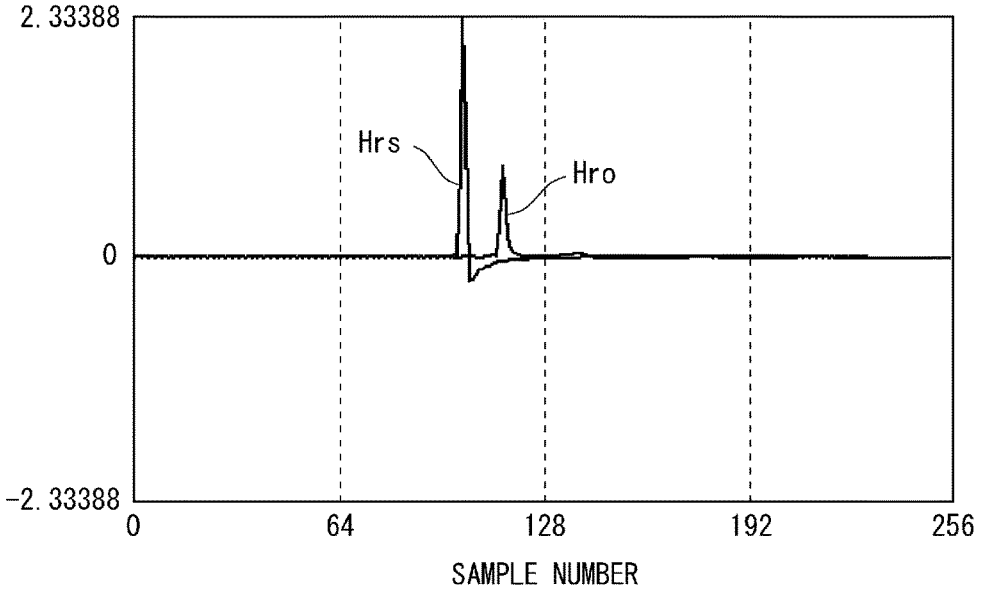
FIG. 4 is a view showing transfer characteristics Hrs and Hro in the measurement example 1.

In the case of carrying out impulse measurement in such an ideal measurement environment, the transfer characteristics Hls, Hlo, Hro and Hrs as shown in FIGS. 3 and 4 are measured. FIG. 3 shows measurement results of the transfer characteristics Hls and Hlo in the measurement example 1, which is when driving the left speaker 5L. FIG. 4 shows measurement results of the transfer characteristics Hro and Hrs in the measurement example 1, which is when driving the right speaker 5R. The transfer characteristics Hls in FIG. 3 and the transfer characteristics Hrs in FIG. 4 have substantially the same waveform. Specifically, peaks with substantially the same amplitude appear at substantially the same timing in the transfer characteristics Hls and the transfer characteristics Hrs. Specifically, the arrival time of an impulse sound from the left speaker 5L to the left microphone 2L and the arrival time of an impulse sound from the right speaker 5R to the right microphone 2R coincide with each other.

Figure 5:
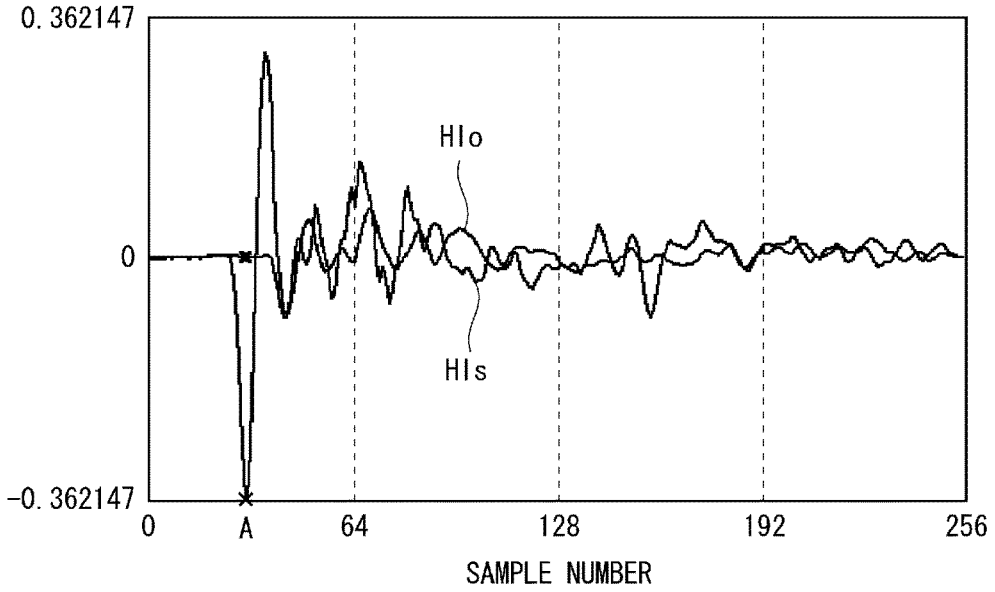
FIG. 5 is a view showing transfer characteristics Hls and Hlo in a measurement example 2.
Figure 6:
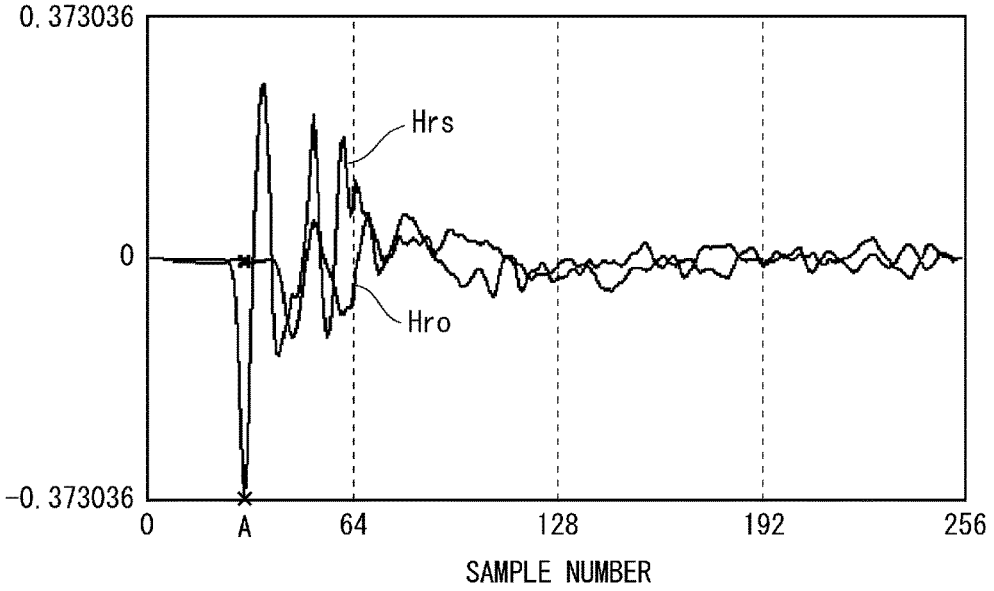
FIG. 6 is a view showing transfer characteristics Hrs and Hro in the measurement example 2.
Figure 7:
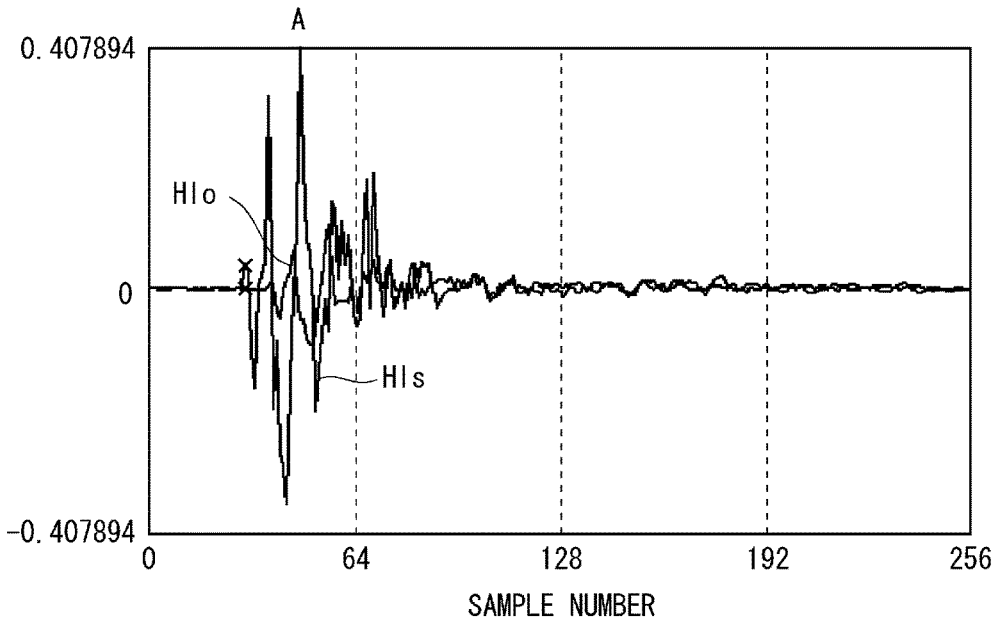
FIG. 7 is a view showing transfer characteristics Hls and Hlo in a measurement example 3.
Figure 8:
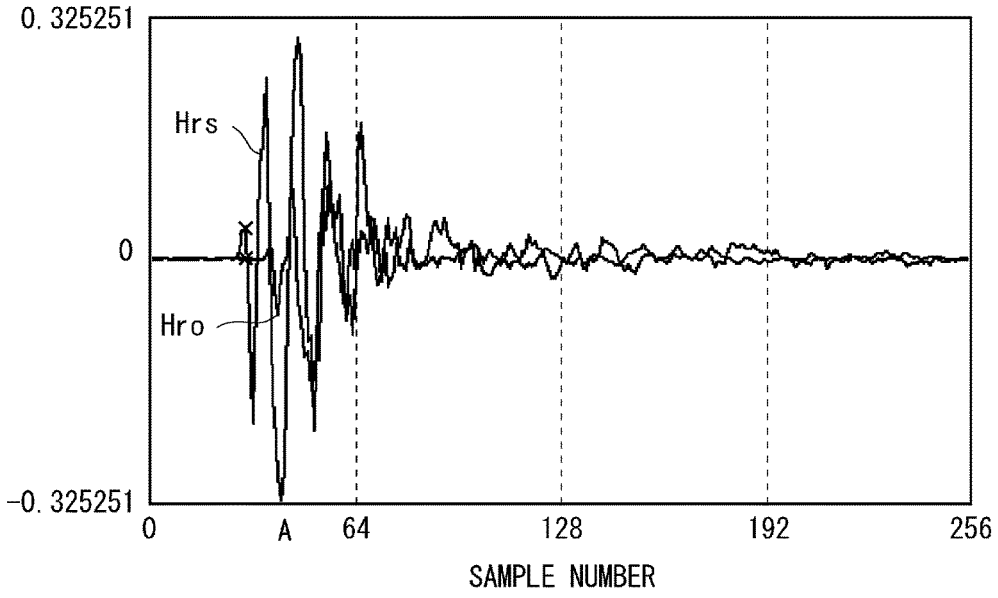
FIG. 8 is a view showing transfer characteristics Hrs and Hro in the measurement example 3.

The transfer characteristics measured in the measurement environment where actual measurement is carried out are shown as measurement examples 2 and 3 in FIGS. 5 to 8. FIG. 5 shows the transfer characteristics Hls and Hlo in the measurement example 2, and FIG. 6 shows the transfer characteristics Hro and Hrs in the measurement example 2. FIG. 7 shows the transfer characteristics Hls and Hlo in the measurement example 3, and FIG. 8 shows the transfer characteristics Hro and Hrs in the measurement example 3. The measurement examples 2 and 3 are measurements carried out in different measurement environments, which is carried out in the measurement environments with echoes from an object near a listener, a wall surface, a ceiling and a floor.

When the actual measurement environment is at home of the listener 1 or the like, impulse sounds are output from the stereo speakers 5 by a personal computer, a smart phone or the like. In other words, a general-purpose processor such as a personal computer or a smart phone is used as an acoustic device. In such a case, there is a possibility that the amount of delay in the acoustic device varies from measurement to measurement. For example, a signal delay occurs by processing in a processor of the acoustic device or processing in an interface.

Thus, even when a rigid sphere is placed at the center of the stereo speakers 5, a response position (peak position) differs between when driving the left speaker 5L and when driving the right speaker 5R due to a delay in the acoustic device. In such a case, the transfer characteristics are cut out so that the maximum amplitude (the amplitude where the absolute value reaches its maximum) is at the same time as shown in the measurement examples 2 and 3. For example, in the measurement example 2, the transfer characteristics Hls, Hlo, Hro and Hrs are cut out so that the maximum amplitude A of the transfer characteristics Hls and Hrs appears at the 30th sample. Note that, in the measurement example 2, the maximum amplitude is a negative peak (A in FIGS. 5 and 6).

However, there is a case where the left and right auricle shapes of the listener 1 are different. In this case, even when the listener 1 is located in a symmetrical position with respect to the left and right speakers 5L and 5R, the left and right transfer characteristics are largely different. Further, the left and right transfer characteristics are largely different also when the measurement environment is asymmetric.

Figure 9:
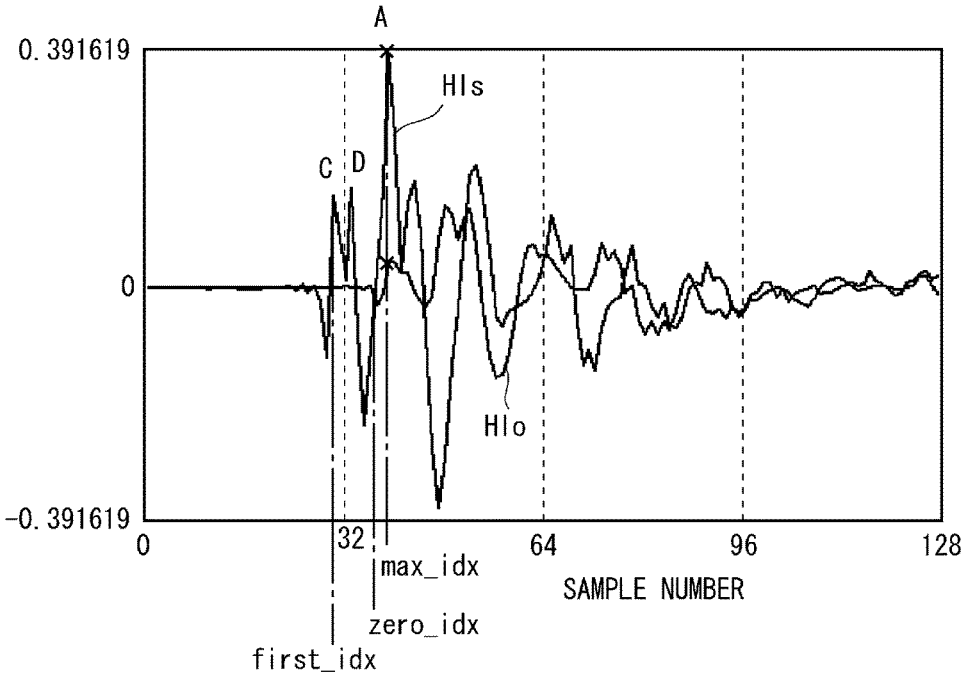
FIG. 9 is a view showing transfer characteristics Hls and Hlo in a measurement example 4.
Figure 10:
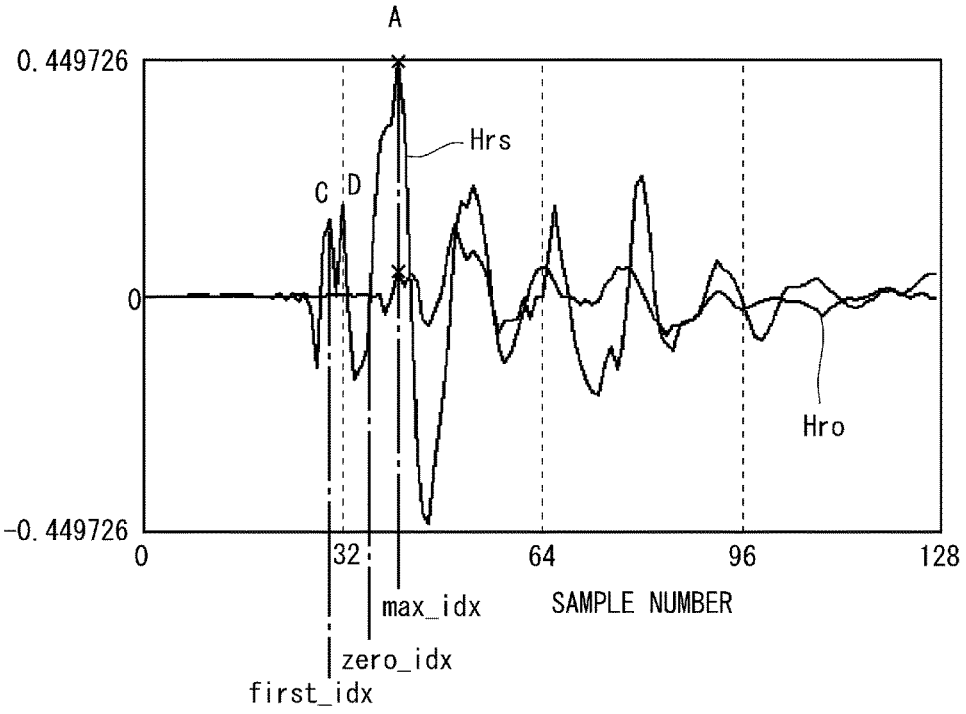
FIG. 10 is a view showing transfer characteristics Hrs and Hro in the measurement example 4.

Further, when carrying out measurement in the actual measurement environment, there is a case where the peak with the maximum amplitude is split into two peaks as in the measurement example 4 shown in FIGS. 9 and 10. In the measurement example 4, the maximum amplitude A of the transfer characteristics Hrs is split into two peaks as shown in FIG. 10.

Figure 11:
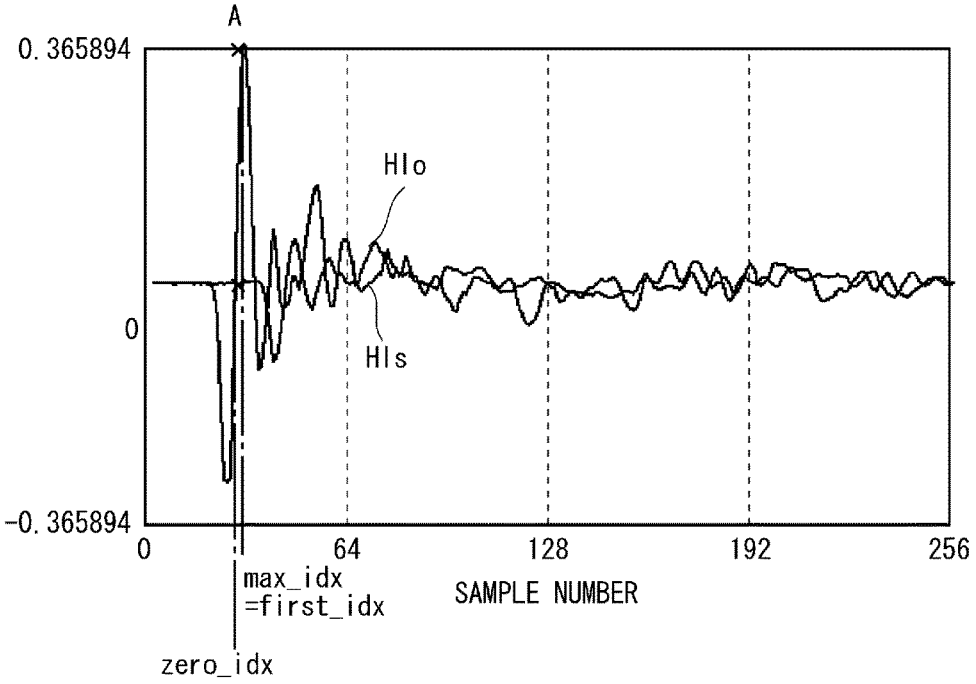
FIG. 11 is a view showing transfer characteristics Hls and Hlo in a measurement example 5.
Figure 12:
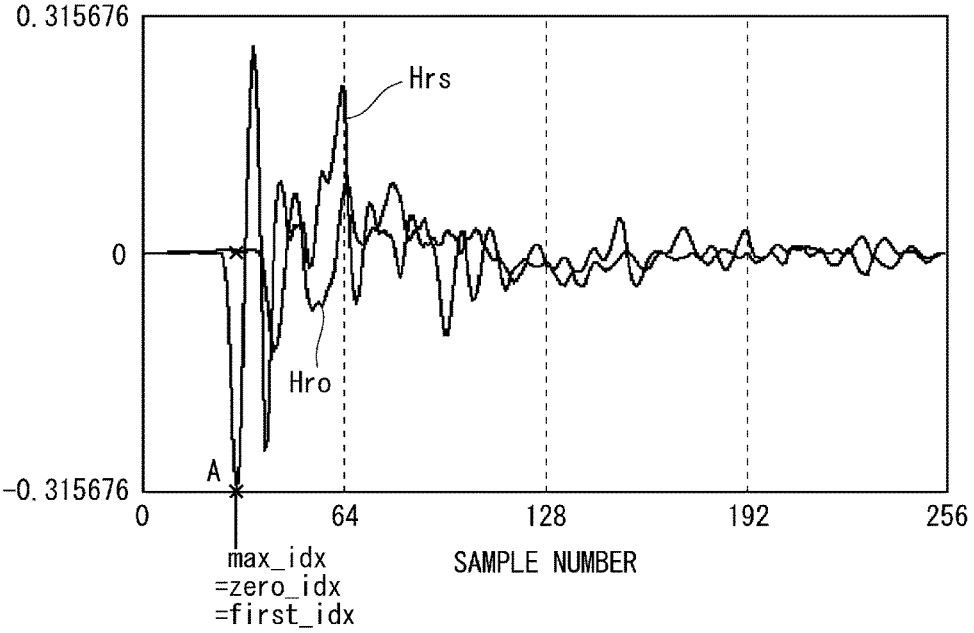
FIG. 12 is a view showing transfer characteristics Hrs and Hro in the measurement example 5.

Further, there is a case where the sign of the peak with the maximum amplitude differs between the left and right transfer characteristics Hls and Hrs as in the measurement example 5 shown in FIGS. 11 and 12. In the measurement example 5, the maximum amplitude A of the transfer characteristics Hls has a positive peak (FIG. 11), and the maximum amplitude A of the transfer characteristics Hrs has a negative peak (FIG. 12).

Figure 13:
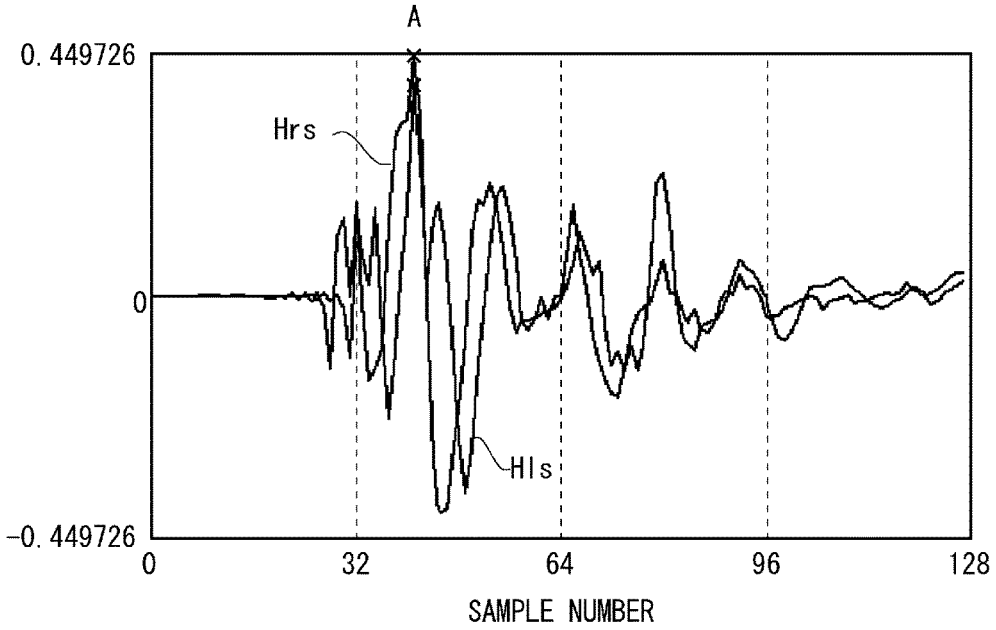
FIG. 13 is a view showing cut out transfer characteristics Hls and Hrs in the measurement example 4.
Figure 14:
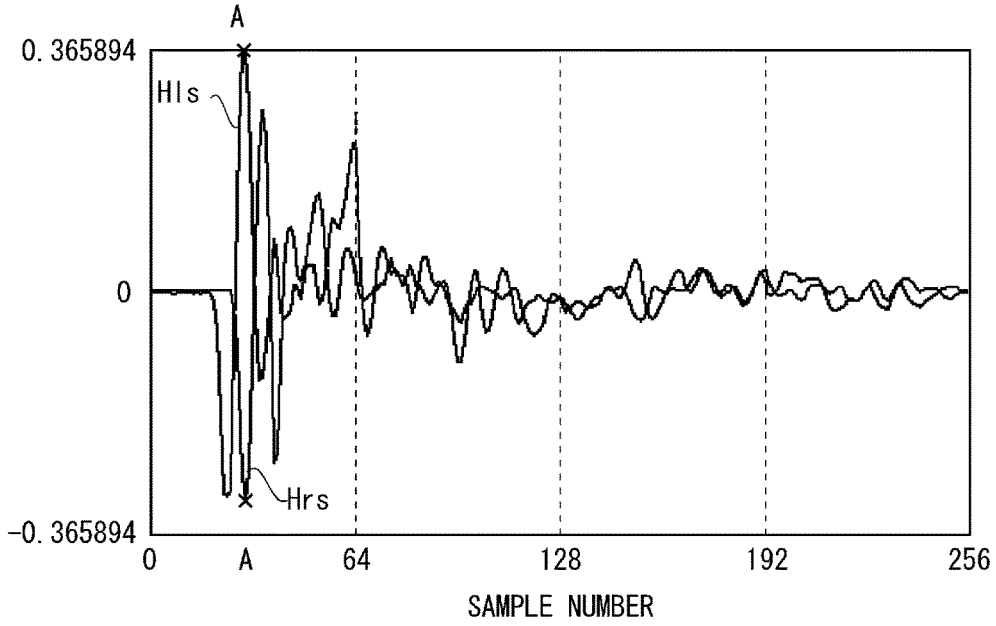
FIG. 14 is a view showing cut out transfer characteristics Hls and Hrs in the measurement example 5.

When the signal waveforms of the left and right transfer characteristics Hls and Hrs are largely different, the arrival times of sounds from the left and right stereo speakers 5 do not coincide with each other. Accordingly, when the out-of-head localization unit 10 performs the convolution calculation, sound fields with a good balance between left and right cannot be obtained in some cases. For example, FIGS. 13 and 14 show the transfer characteristics equally cut out at the sample position (or time) where the transfer characteristics Hls and Hrs have the maximum amplitude in the measurement example 4 and the measurement example 5. FIG. 13 shows the transfer characteristics Hls and Hrs in the measurement example 4, and FIG. 14 shows the transfer characteristics Hls and Hrs in the measurement example 5.

When the waveforms of the left and right transfer characteristics Hls and Hrs are largely different as shown in FIGS. 13 and 14, there is a possibility that sound fields with a good balance between left and right cannot be obtained. For example, a vocal sound image to be localized at the center is deviated to left or right. In this manner, there is a case where the transfer characteristics obtained by different impulse response measurements cannot be cut out appropriately. In other words, there is a case where a filter cannot be generated appropriately. In this embodiment, the filter generation device 200 performs the following processing and thereby achieves appropriate cutout.

Figure 15:
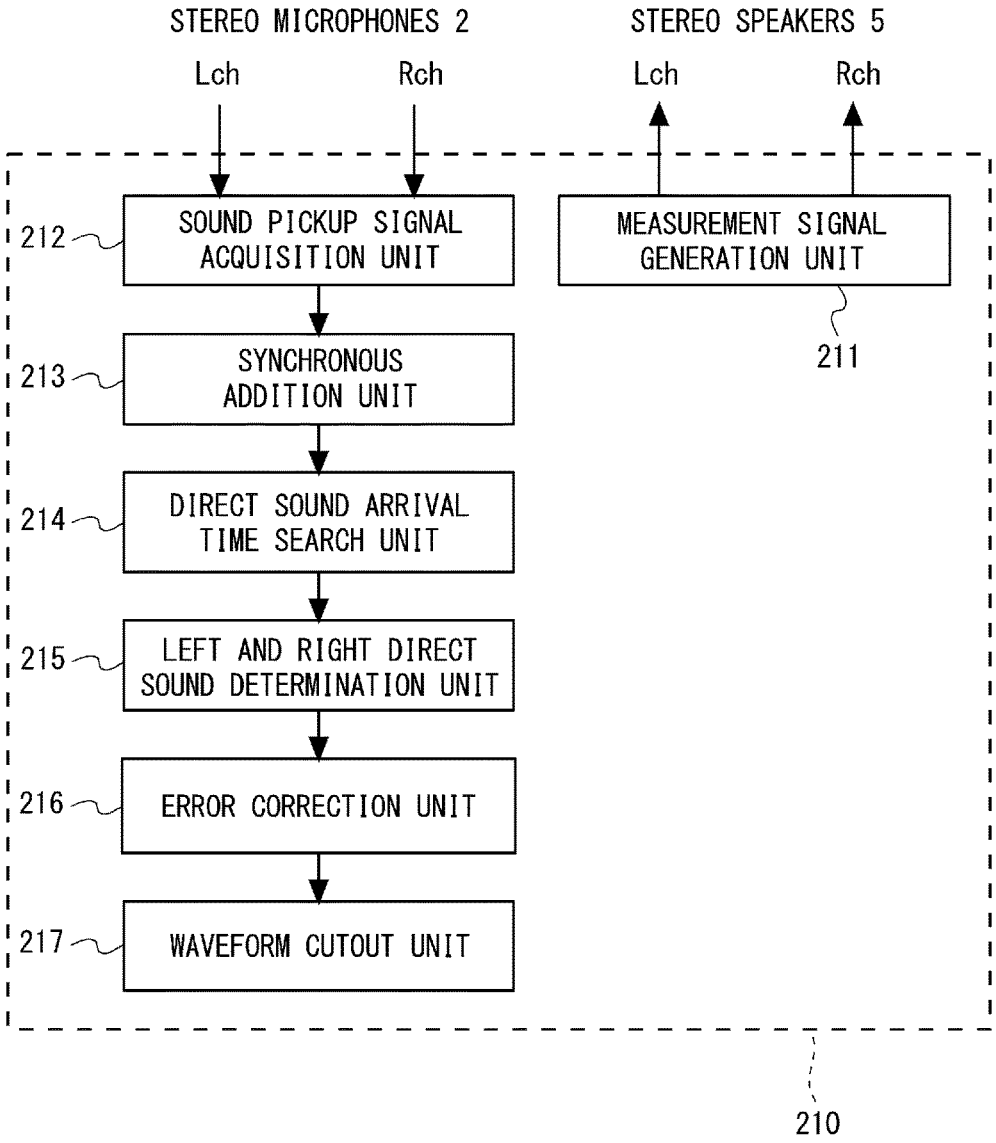
FIG. 15 is a control block diagram showing the structure of a filter generation device.

The structure of a processor 210 of the filter generation device 200 is described hereinafter with reference to FIG. 15. FIG. 15 is a block diagram showing the structure of the processor 210. The processor 210 includes a measurement signal generation unit 211, a sound pickup signal acquisition unit 212, a synchronous addition unit 213, a direct sound arrival time search unit 214, a left and right direct sound determination unit 215, an error correction unit 216, and a waveform cutout unit 217. For example, the processor 210 is an information processor such as a personal computer, a smart phone, a tablet terminal or the like, and it includes an audio input interface (IF) and an audio output interface. Thus, the processor 210 is an acoustic device having input/output terminals connected to the stereo microphones 2 and the stereo speakers 5.

The measurement signal generation unit 211 includes a D/A converter, an amplifier and the like, and it generates a measurement signal. The measurement signal generation unit 211 outputs the generated measurement signal to each of the stereo speakers 5. Each of the left speaker 5L and the right speaker 5R outputs a measurement signal for measuring the transfer characteristics. The impulse response measurement by the left speaker 5L and the impulse response measurement by the right speaker 5R are carried out.

Each of the left microphone 2L and the right microphone 2R of the stereo microphones 2 picks up the measurement signal, and outputs the sound pickup signal to the processor 210. The sound pickup signal acquisition unit 212 acquires the sound pickup signals from the left microphone 2L and the right microphone 2R. Note that the sound pickup signal acquisition unit 212 includes an A/D converter, an amplifier and the like, and it may perform A/D conversion, amplification and the like of the sound pickup signals from the left microphone 2L and the right microphone 2R. The sound pickup signal acquisition unit 212 outputs the acquired sound pickup signals to the synchronous addition unit 213.

By driving of the left speaker 5L, a first sound pickup signal in accordance with the transfer characteristics Hls between the left speaker 5L and the left microphone 2L and a second sound pickup signal in accordance with the transfer characteristics Hlo between the left speaker 5L and the right microphone 2R are acquired at the same time. Further, by driving of the right speaker 5R, a third sound pickup signal in accordance with the transfer characteristics Hro between the right speaker 5R and the left microphone 2L and a fourth sound pickup signal in accordance with the transfer characteristics Hrs between the right speaker 5R and the right microphone 2R are acquired at the same time.

The synchronous addition unit 213 performs synchronous addition of the sound pickup signals. The synchronous addition is to synchronize and add the sound pickup signals acquired by a plurality of impulse response measurements. By performing the synchronous addition, it is possible to reduce the effect of unexpected noise. For example, the number of times of the synchronous addition may be 10. In this manner, the synchronous addition unit 213 performs synchronous addition of the sound pickup signals and thereby acquires the transfer characteristics Hls, Hlo, Hro and Hrs.

Then, the direct sound arrival time search unit 214 searches for the direct sound arrival times of the synchronized and added transfer characteristics Hls and Hrs. The direct sound is a sound that directly arrives at the left microphone 2L from the left speaker 5L and a sound that directly arrives at the right microphone 2R from the right speaker 5R. Specifically, the direct sound is a sound that arrives at the microphones 2L and 2R from the speakers 5L and 5R without being reflected off a surrounding structural object such as a wall, floor, ceiling, and ear canal. Normally, the direct sound is a sound that arrives at the microphones 2L and 2R at the earliest time. The direct sound arrival time corresponds to the time that has passed from the start of measurement to the arrival of the direct sound.

To be more specific, the direct sound arrival time search unit 214 searches for the direct sound arrival times based on the times when the amplitudes of the transfer characteristics Hls and Hrs reaches their maximum. Note that processing of the direct sound arrival time search unit 214 is described later. The direct sound arrival time search unit 214 outputs the searched direct sound arrival times to the left and right direct sound determination unit 215.

The left and right direct sound determination unit 215 determines whether the signs of the amplitudes of left and right direct sounds match or not by using the direct sound arrival times searched by the direct sound arrival time search unit 214. For example, the left and right direct sound determination unit 215 determines whether the signs of the amplitudes of the transfer characteristics Hls and Hrs at the direct sound arrival time match or not. Further, the left and right direct sound determination unit 215 determines whether the direct sound arrival times coincide or not. The left and right direct sound determination unit 215 outputs a determination result to the error correction unit 216.

When the signs of the amplitudes of the transfer characteristics Hls and Hrs at the direct sound arrival time are not the same, the error correction unit 216 corrects the cutout timing. Then, the waveform cutout unit 217 cuts out the waveforms of the transfer characteristics Hls, Hlo, Hro and Hrs at the corrected cutout timing. The transfer characteristics Hls, Hlo, Hro and Hrs that are cut out with a specified filter length serve as filters. Specifically, the waveform cutout unit 217 cuts out the waveforms of the transfer characteristics Hls, Hlo, Hro and Hrs by shifting the head position. When the signs of the amplitudes of the transfer characteristics Hls and Hrs at the direct sound arrival time match, the waveform cutout unit 217 cuts out their waveforms without correcting the cutout timing.

To be specific, when the signs of the amplitudes of the transfer characteristics Hls and Hrs are different, the error correction unit 216 corrects the cutout timing so that the direct sound arrival times of the transfer characteristics Hls and Hrs coincide with each other. Data of the transfer characteristics Hls and Hlo or the transfer characteristics Hro and Hrs are shifted so that the direct sounds of the transfer characteristics Hls and Hrs are at the same sample number. Specifically, the head sample number for cutout is made different between the transfer characteristics Hls and Hlo and the transfer characteristics Hro and Hrs.

Then, the waveform cutout unit 217 generates filters from the cut out transfer characteristics Hls, Hlo, Hro and Hrs. Specifically, the waveform cutout unit 217 sets the amplitudes of the transfer characteristics Hls, Hlo, Hro and Hrs as the filter coefficient and thereby generates filters. The transfer characteristics Hls, Hlo, Hro and Hrs generated by the waveform cutout unit 217 are set, as filters, to the convolution calculation units 11, 12, 21 and 22 shown in FIG. 1. The user U can thereby listen to the audio on which the out-of-head localization is carried out with the sound quality with a good balance between left and right.

Figure 16:
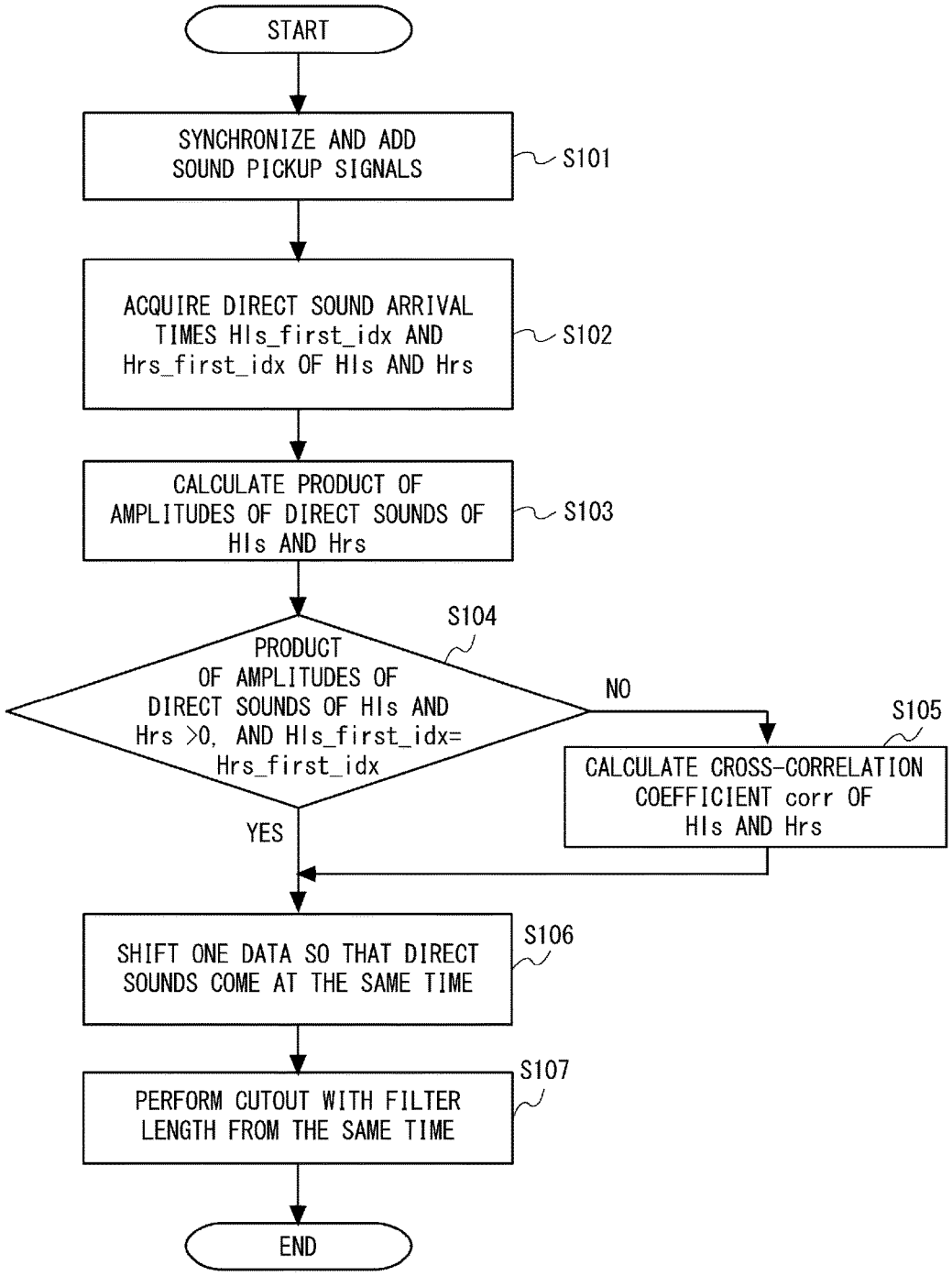
FIG. 16 is a flowchart showing a filter generation method.

A filter generation method by the processor 210 is described hereinafter in detail with reference to FIG. 16. FIG. 16 is a flowchart showing a filter generation method by the processor 210.

First, the synchronous addition unit 213 performs synchronous addition of the sound pickup signals (S101). Specifically, the synchronous addition unit 213 performs synchronous addition of the sound pickup signals for each of the transfer characteristics Hls, Hlo, Hro and Hrs. It is thereby possible to reduce the effect of unexpected noise.

Then, the direct sound arrival time search unit 214 acquires the direct sound arrival time Hls_First_idx in the transfer characteristics Hls and the direct sound arrival time Hrs_First_idx in the transfer characteristics Hrs (S102).

Figure 17:
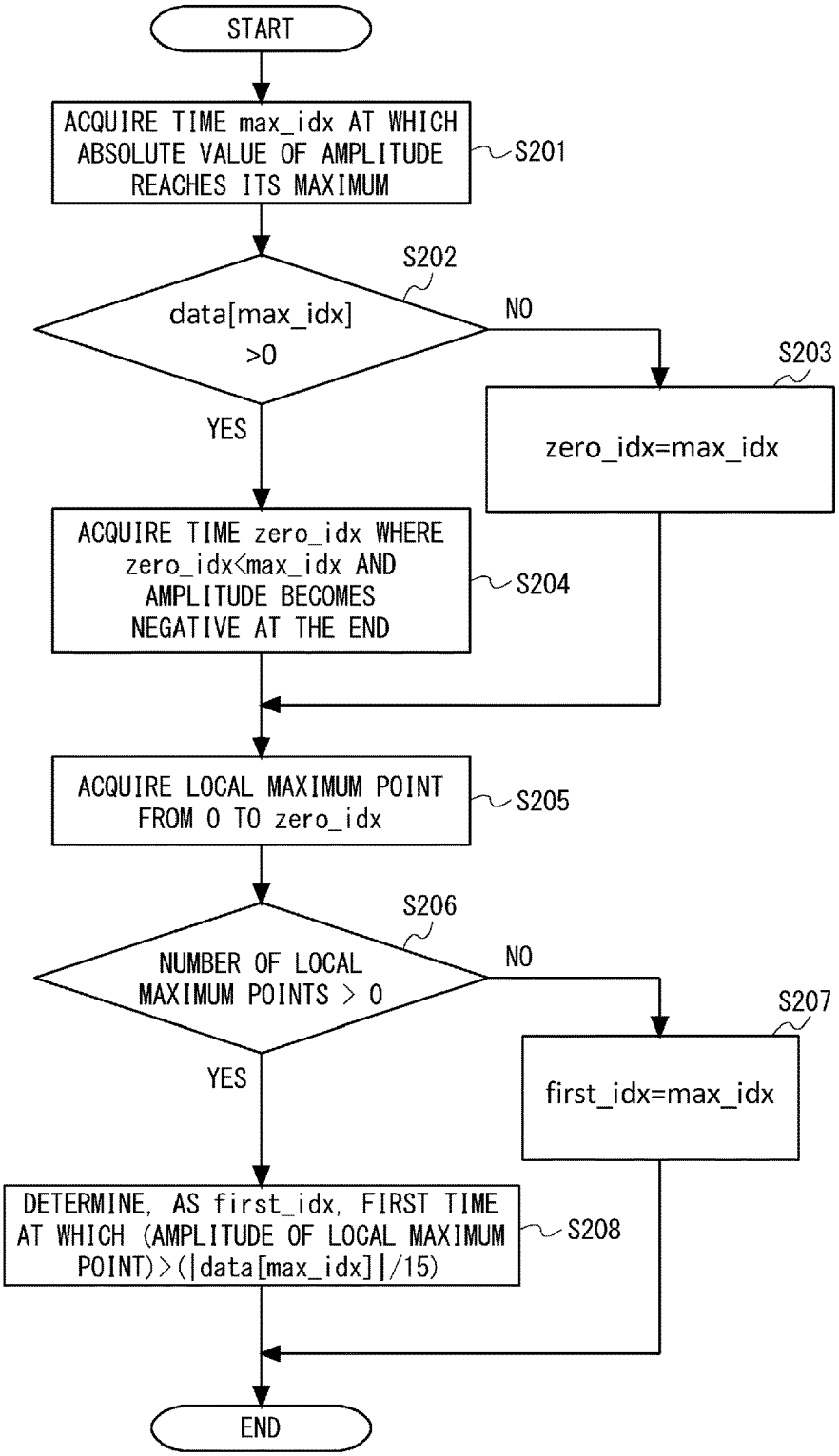
FIG. 17 is a flowchart showing a direct sound search process.

A search process of the direct sound arrival time in the direct sound arrival time search unit 214 is described hereinafter in detail with reference to FIG. 17. FIG. 17 is a flowchart showing a search process of the direct sound arrival time. Note that FIG. 17 shows a process to be performed for each of the transfer characteristics Hls and the transfer characteristics Hrs. Specifically, the direct sound arrival time search unit 214 carries out the process shown in FIG. 17 for each of the transfer characteristics Hls and Hrs and thereby acquires the direct sound arrival time Hls_First_idx and the direct sound arrival time Hrs_First_idx, respectively.

First, the direct sound arrival time search unit 214 acquires the time max_idx at which the absolute value of the amplitude of the transfer characteristics reaches its maximum (S201). Specifically, the direct sound arrival time search unit 214 sets the time max_idx to the time at which the maximum amplitude A is reached as shown in FIGS. 9 to 12. The time max_idx corresponds to the time elapsed from the start of measurement. Further, the time max_idx and the various times described later may be represented as an absolute time from the start of measurement, or may be represented as the sample number from the start of measurement.

Next, the direct sound arrival time search unit 214 determines whether data[max_idx] at the time max_idx is greater than 0 (S202). data[max_idx] is the value of the amplitude of the transfer characteristics at max_idx. In other words, the direct sound arrival time search unit 214 determines whether the maximum amplitude is a positive peak or a negative peak. When data[max_idx] is negative (No in S202), the direct sound arrival time search unit 214 sets zero_idx=max_idx (S203). In the amplitude Hrs shown in FIG. 12, because the maximum amplitude A is negative, max_idx=zero_idx.

zero_idx is the time as a reference of the search range of the direct sound arrival time. To be specific, the time zero_idx corresponds to the end of the search range. The direct sound arrival time search unit 214 searches for the direct sound arrival time within the range of 0 to zero_idx.

When data[max_idx] is positive (Yes in S202), the direct sound arrival time search unit 214 acquires the time zero_idx where zero_idx<max_idx and the amplitude becomes negative at the end (S204). Specifically, the direct sound arrival time search unit 214 sets, as zero_idx, the time at which the amplitude becomes negative immediately before the time max_idx. For example, in the transfer characteristics shown in FIGS. 9 to 11, because the maximum amplitude A is positive, zero_idx exists before the time max_idx. Although the time at which the amplitude becomes negative immediately before the time max_idx is the end of the search range in this example, the end of the search range is not limited thereto.

When zero_idx is set in Step S203 or S204, the direct sound arrival time search unit 214 acquires the local maximum point from 0 to zero_idx (S205). Specifically, the direct sound arrival time search unit 214 extracts the positive peak of the amplitude in the search range 0 to zero_idx.

The direct sound arrival time search unit 214 determines whether the number of local maximum points is greater than 0 (S206). Specifically, the direct sound arrival time search unit 214 determines whether the local maximum point (positive peak) exists in the search range 0 to zero_idx.

When the number of local maximum points is equal to or smaller than 0 (No in S206), which is, when the local maximum point does not exist in the search range 0 to zero_idx, the direct sound arrival time search unit 214 sets first_idx=max_idx. first_idx is the direct sound arrival time. For example, in the transfer characteristics Hls and Hrs shown in FIGS. 11 and 12. the local maximum point does not exist in the range of 0 to zero_idx. Thus, the direct sound arrival time search unit 214 sets the direct sound arrival time first_idx=max_idx.

When the number of local maximum points is greater than 0 (Yes in S206), which is, when the local maximum point exists in the search range 0 to zero_idx, the direct sound arrival time search unit 214 sets, as the direct sound arrival time first_idx, the first time at which the amplitude of the local maximum point becomes greater than (|data[max_idx]|/15) (S208). Specifically, the positive peak at the earliest time in the search range 0 to zero_idx, which is the peak higher than a threshold (1/15 of the absolute value of the maximum amplitude in this example), is set as the direct sound. For example, in the transfer characteristics shown in FIGS. 9 and 10, the local maximum points C and D exist within the search range 0 to zero_idx. Further, the amplitude of the first local maximum point C is greater than the threshold. Thus, the direct sound arrival time search unit 214 sets the time of the local maximum point C to the direct sound arrival time first_idx.

When the amplitude of the local maximum point is small, there is a possibility that it is caused by noise or the like. It is thus required to determine whether the local maximum point is caused by noise or direct sounds from speakers. Therefore, in this embodiment, (absolute value of data [max_idx]/15 is set as a threshold, and the local maximum point that is greater than this threshold is determined to be direct sounds. In this manner, the direct sound arrival time search unit 214 sets the threshold in accordance with the maximum amplitude.

Then, the direct sound arrival time search unit 214 compares the amplitude of the local maximum point with the threshold, and thereby determines whether the local maximum point is caused by noise or by direct sounds. Specifically, when the amplitude of the local maximum point is less than a specified proportion of the absolute value of the maximum amplitude, the direct sound arrival time search unit 214 determines the local maximum point as noise. When, on the other hand, the amplitude of the local maximum point is equal to or more than a specified proportion of the absolute value of the maximum amplitude, the direct sound arrival time search unit 214 determines the local maximum point as direct sounds. The effect of noise is thereby removed, and it is thus possible to accurately search for the direct sound arrival time The threshold for determining noise is not limited to the above-described value as a matter of course, and an appropriate proportion may be set in accordance with the measurement environment, measurement signals and the like. Further, the threshold may be set regardless of the maximum amplitude.

The direct sound arrival time search unit 214 calculates the direct sound arrival time first_idx as described above. To be specific, the direct sound arrival time search unit 214 sets, as the direct sound arrival time first_idx, the time when the amplitude is the local maximum point before the time max_idx at which the absolute value of the amplitude is maximum. Specifically, the direct sound arrival time search unit 214 determines the first positive peak before the maximum amplitude as direct sounds. When the local maximum point does not exist before the maximum amplitude, the direct sound arrival time search unit 214 determines the maximum amplitude as direct sounds. The direct sound arrival time search unit 214 outputs the searched direct sound arrival times first_idx to the left and right direct sound determination unit 215.

Referring back to FIG. 16, the left and right direct sound determination unit 215 acquires the direct sound arrival times Hls_first_idx and Hrs_first_idx of the transfer characteristics Hls and Hrs, respectively, as described above. The left and right direct sound determination unit 215 calculates the product of the amplitudes of the direct sounds of the transfer characteristics Hls and Hrs (S103). Specifically, the left and right direct sound determination unit 215 multiplies the amplitude of the transfer characteristics Hls at the direct sound arrival time Hls_first_idx by the amplitude of the transfer characteristics Hrs at the direct sound arrival time Hrs_first_idx, and determines whether the negative/positive signs of the maximum amplitudes of Hls and Hrs match or not.

After that, the left and right direct sound determination unit 215 determines whether (product of amplitudes of direct sounds of transfer characteristics Hls and Hrs)>0 and Hls_first_idx=Hrs_first_idx are satisfied (S104). In other words, the left and right direct sound determination unit 215 determines whether the signs of the amplitudes of the transfer characteristics Hls and Hrs at the direct sound arrival time match or not. Further, the left and right direct sound determination unit 215 determines whether the direct sound arrival time Hls_first_idx coincides with the direct sound arrival time Hrs_first_idx.

When the amplitudes at the direct sound arrival time match and Hls_first_idx coincides with the direct sound arrival time Hrs_first_idx (Yes in S104), the error correction unit 216 shifts one data so that the direct sounds come at the same time (S106). Note that, when the shift of the transfer characteristics is not necessary, the data shift amount is 0. For example, when the determination in Step S104 results in Yes, the data shift amount is 0. In this case, the process may skip Step S106 and proceeds to Step S107. Then, the waveform cutout unit 217 cuts out the transfer characteristics Hls, Hlo, Hro and Hrs with a filter length from the same time (S107).

When the product of the amplitudes of direct sounds of the transfer characteristics Hls and Hrs is negative, or when Hls_first_idx=Hrs_first_idx is not satisfied (No in S104), the error correction unit 216 calculates the cross-correlation coefficient corr of the transfer characteristics Hls and Hrs (S105). Specifically, because left and right direct sound arrival times do not coincide, the error correction unit 216 corrects the cutout timing. Thus, the error correction unit 216 calculates the cross-correlation coefficient corr of the transfer characteristics Hls and Hrs.

Then, the error correction unit 216 shifts one data so that the direct sounds come at the same time based on the cross-correlation coefficient corr (S106). To be specific, data of the transfer characteristics Hrs and Hro are shifted so that the direct sound arrival time Hls_first_idx coincides with the direct sound arrival time Hrs_first_idx. The shift amount of data of the transfer characteristics Hrs and Hro is determined in accordance with the offset amount where the correlation is the highest. In this manner, the error correction unit 216 corrects the cutout timing based on the correlation between the transfer characteristics Hls and Hrs. The waveform cutout unit 217 cuts out the transfer characteristics Hls, Hlo, Hro and Hrs with a filter length (S107).

Figure 18:
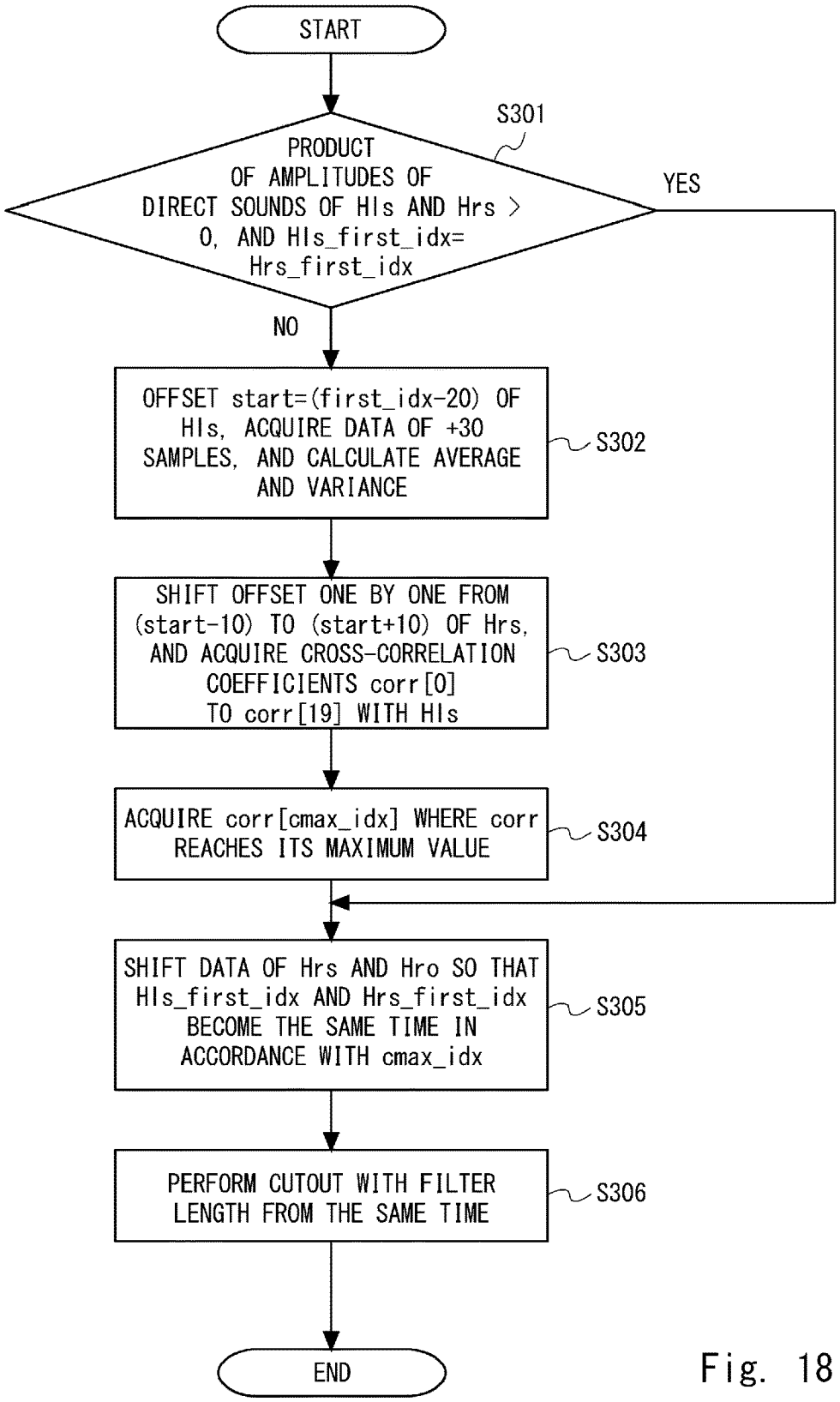
FIG. 18 is a flowchart showing a detailed example of the process shown in FIG. 17.

An example of a process from Steps S104 to S107 is described hereinafter with reference to FIG. 18. FIG. 18 is a flowchart showing an example of a process from Steps S104 to S107.

First, the left and right direct sound determination unit 215 makes determination on left and right sounds, just like in Step S104. Specifically, the left and right direct sound determination unit 215 determines whether the product of the amplitudes of direct sounds of the transfer characteristics Hls and Hrs>0 and Hls_first_idx=Hrs_first_idx are satisfied or not (S301).

When the product of the amplitudes of direct sounds of the transfer characteristics Hls and Hrs>0 and Hls_first_idx=Hrs_first_idx are satisfied (Yes in S301), the error correction unit 216 shifts the data of the transfer characteristics Hrs and Hro so that Hls_first_idx=Hrs_first_idx are at the same time (S305). Note that, when the shift of the transfer characteristics is not necessary, the data shift amount is 0. For example, when the determination in Step S301 results in Yes, the data shift amount is 0. In this case, the process may skip Step S305 and proceeds to Step S306. Then, the waveform cutout unit 217 cuts out the transfer characteristics Hls, Hlo, Hro and Hrs with a filter length from the same time (S306). Specifically, the error correction unit 216 corrects the cutout timing of the transfer characteristics Hro and Hrs so that the direct sound arrival time coincides with each other. Then, the waveform cutout unit 217 cuts out the transfer characteristics Hls, Hlo, Hro and Hrs at the cutout timing corrected by the error correction unit 216.

When the product of the amplitudes of direct sounds of the transfer characteristics Hls and Hrs<0, or Hls_first_idx=Hrs_first_idx is not satisfied (No in S301), the error correction unit 216 offsets start=(first_idx−20) of the transfer characteristics Hls, acquires data of +30 samples, and calculates the average and variance (S302). Specifically, the error correction unit 216 extracts data of 30 successive samples where the starting point "start" is at 20 samples before the direct sound arrival time first_idx. The error correction unit 216 then calculates the average and variance of the extracted 30 samples. Because the average and variance are used for the standardization of the cross-correlation coefficient, they are not necessarily calculated when the standardization is not needed. Note that the number of samples to be extracted is not limited to 30 samples, and the error correction unit 216 may extract an arbitrary number of samples.

Then, the error correction unit 216 shifts the offset one by one from (start−10) to (start+10) of the transfer characteristics Hrs, and acquires the cross-correlation coefficients corr[0] to corr[19] with the transfer characteristics Hls (S303). Note that the error correction unit 216 preferably standardizes the cross-correlation coefficients corr by using the average and variance of the transfer characteristics Hls and Hrs.

A method of calculating the cross-correlation coefficients is described hereinafter with reference to FIG. 19. In the middle part of FIG. 19, the transfer characteristics Hls and 30 samples that are extracted from the transfer characteristics Hls are shown in a thick frame G. Further, in the upper part of FIG. 19, the transfer characteristics Hrs and 30 samples when (start−10) is offset are shown in a thick frame F. Because first_idx−20=start, 30 samples, which begin at first_idx−30, are shown in the thick frame F in the upper part of FIG. 19.

Figure 19:
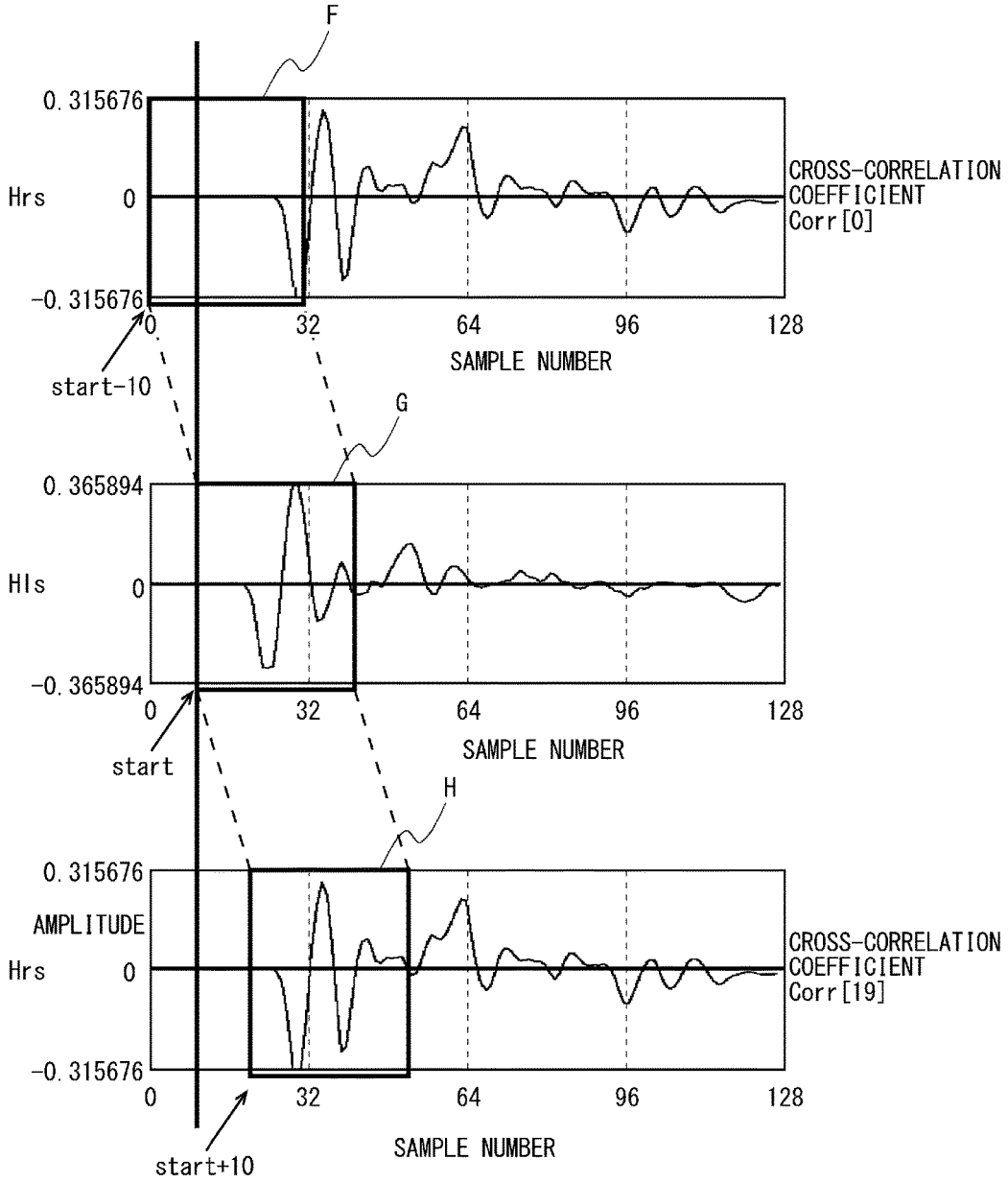
FIG. 19 is a view illustrating a process of calculating a cross-correlation coefficient.

Further, in the lower part of FIG. 19, the transfer characteristics Hrs and 30 samples when (start−10) is offset are shown in a thick frame H. Because first_idx−20=start, 30 samples, which begin at first_idx−10, are shown in the thick frame H in the lower part of FIG. 19. By calculating the cross-correlation between the 30 samples in the thick frame F and the 30 samples in the thick frame G, the cross-correlation coefficient corr[0] is obtained. Likewise, by calculating the cross-correlation between the thick frame G and the thick frame H, the cross-correlation coefficient corr[19] is obtained. As the cross-correlation coefficient corr is higher, the correlation between the transfer characteristics Hls and Hrs is higher.

The error correction unit 216 acquires corr[cmax_idx] where the cross-correlation coefficient reaches its maximum value (S304). cmax_idx corresponds to the offset amount where the cross-correlation coefficient reaches its maximum value. In other words, cmax_idx indicates the offset amount when the correlation between the transfer characteristics Hls and the transfer characteristics Hrs is the highest.

Then, the error correction unit 216 shifts the data of the transfer characteristics Hrs and Hro so that Hls_first_idx and Hrs_first_idx become the same time in accordance with cmax_idx (S305). The error correction unit 216 shifts the data of the transfer characteristics Hrs and Hro by the offset amount. The direct sound arrival times of the transfer characteristics Hls and Hrs thereby coincide with each other. Note that Step S305 corresponds to Step S106 in FIG. 16. Further, the error correction unit 216 may shift the transfer characteristics Hls and Hlo instead of shifting the transfer characteristics Hrs and Hro.

After that, the waveform cutout unit 217 cuts out the transfer characteristics Hls, Hlo, Hro and Hrs with a filter length from the same time. It is thereby possible to generate filters where the direct sound arrival times coincide. It is thus possible to generate sound fields with a good balance between left and right. The vocal sound image can be thereby localized at the center.

Figure 20A:
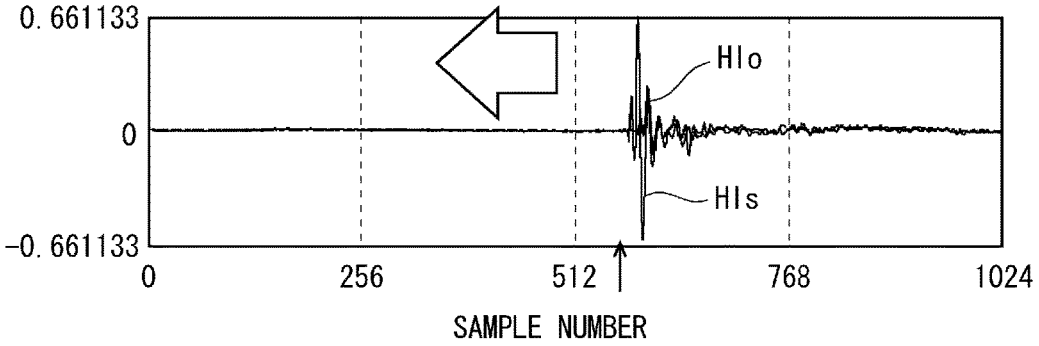
FIG. 20A is a view illustrating a delay by an acoustic device.
Figure 20B:
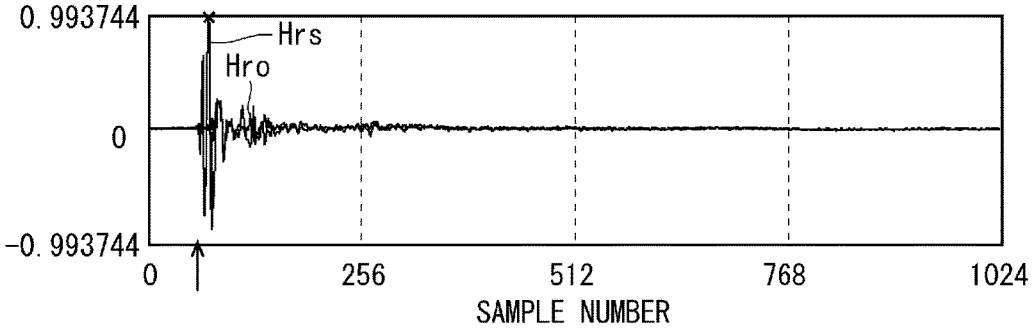
FIG. 20B is a view illustrating a delay by an acoustic device.
Figure 20C:
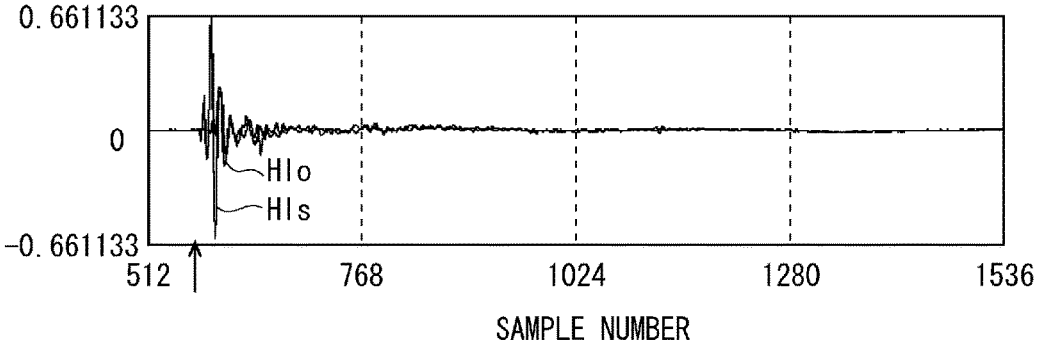
FIG. 20C is a view illustrating a delay by an acoustic device.

The significance of making the direct sound arrival times coincide with each other is described hereinafter with reference to FIGS. 20A to 20C. FIG. 20A is a view showing the transfer characteristics Hls and Hlo before the direct sound arrival times coincide. FIG. 20B is a view showing the transfer characteristics Hrs and Hro. FIG. 20C is a view showing the transfer characteristics Hls and Hlo after the direct sound arrival times coincide. In FIGS. 20A to 20C, the horizontal axis indicates the sample number, and the vertical axis indicates the amplitude. The sample number corresponds to the time elapsed from the start of measurement, and the measurement start time is the sample number 0.

For example, there is a case where the amount of delay in the acoustic device differs between impulse response measurement from the left speaker 5L and impulse response measurement from the right speaker 5R. In this case, the direct sound arrival times of the transfer characteristics Hls and Hlo shown in FIG. 20A delay behind the transfer characteristics Hrs and Hro shown in FIG. 20B. In such a case, if the transfer characteristics Hls, Hlo, Hro and Hrs are cut out without making the direct sound arrival times coincide with each other, sound fields with a poor balance between left and right are generated. To avoid this, as shown in FIG. 20C, the processor 210 shifts the transfer characteristics Hls and Hlo based on the correlation. The direct sound arrival times of the transfer characteristics Hls and Hrs can thereby coincide with each other.

Then, the processor 210 cuts out the transfer characteristics with the direct sound arrival times coinciding with each other and thereby generates filters. Specifically, the waveform cutout unit 217 cuts out the transfer characteristics where the direct sound arrival times coincide with each other and thereby generates filters. It is thereby possible to reproduce the sound fields with a good balance between left and right.

In this embodiment, the left and right direct sound determination unit 215 determines whether the signs of direct sounds match or not. In accordance with the determination result of the left and right direct sound determination unit 215, the error correction unit 216 performs error correction. To be specific, when the signs of direct sounds do not match, or the direct sound arrival times do not coincide, the error correction unit 216 performs error correction based on the cross-correlation coefficient. When, on the other hand, the signs of direct sounds match, and the direct sound arrival times coincide, the error correction unit 216 does not perform error correction based on the cross-correlation coefficient. Because the frequency that the error correction unit 216 performs error correction is low, it is possible to eliminate unnecessary calculations. Specifically, the error correction unit 216 does not need to calculate the cross-correlation coefficient when the signs of direct sounds match and the direct sound arrival times coincide. It is thereby possible to reduce the calculation time.

Normally, error correction by the error correction unit 216 is not needed. However, there are cases where the characteristics of the left and right speakers 5L and 5R are different or where surrounding reflections are largely different between left and right. There is also a case where the positions of the microphones 2L and 2R are not aligned between the left ear 9L and the right ear 9R. Further, there is a case where the amount of delay of the acoustic device is different. In those cases, it is not possible to appropriately pick up the measurement signals, and the timing is off between left and right. In this embodiment, the error correction unit 216 performs error correction, and thereby generates filters appropriately. It is thereby possible to reproduce the sound fields with a good balance between left and right.

Further, the direct sound arrival time search unit 214 searches for the direct sound arrival time. To be specific, the direct sound arrival time search unit 214 sets, as the direct sound arrival time, the time when the amplitude is the local maximum point before the time with the maximum amplitude. When the local maximum point does not exist before the time with the maximum amplitude, the direct sound arrival time search unit 214 sets the time with the maximum amplitude as the direct sound arrival time. It is thereby possible to appropriately search for the direct sound arrival time. The transfer characteristics are then cut out based on the direct sound arrival time, and it is thus possible to generate filters more appropriately.

The left and right direct sound determination unit 215 determines whether the signs of the amplitudes of the transfer characteristics Hls and Hrs at the direct sound arrival time match. When the signs do not match, the error correction unit 216 corrects the cutout timing. It is thereby possible to appropriately adjust the cutout timing. Further, the left and right direct sound determination unit 215 determines whether the direct sound arrival times of the transfer characteristics Hls and Hrs coincide. When the direct sound arrival times of the transfer characteristics Hls and Hrs do not coincide, the error correction unit 216 corrects the cutout timing. It is thereby possible to appropriately adjust the cutout timing.

When the signs of the amplitudes of the transfer characteristics Hls and Hrs at the direct sound arrival time match and the direct sound arrival times of the transfer characteristics Hls and Hrs coincide, the shift amount of the transfer characteristics is 0. In this case, the error correction unit 216 may skip the processing of correcting the cutout timing. To be specific, when Step S104 results in Yes, Step S106 may be skipped. Alternatively, when Step S301 results in Yes, Step S305 may be skipped. It is thereby possible to eliminate unnecessary processing and reduce the calculation time.

The error correction unit 216 preferably corrects the cutout timing based on the correlation between the transfer characteristics Hls and Hrs. The direct sound arrival times can thereby coincide with each other appropriately. It is thereby possible to reproduce sound fields with a good balance between left and right.

It should be noted that, although the out-of-head localization device that localizes sound images outside the head by using headphones is described as a sound localization device in the above embodiment, this embodiment is not limited to the out-of-head localization device. For example, it may be used for a sound localization device that reproduces stereo signals from the speakers 5L and 5R and localizes sound images. Specifically, this embodiment is applicable to a sound localization device that convolves transfer characteristics to reproduced signals. For example, sound localization filters in virtual speakers, near speaker surround systems or the like can be generated.

A part or the whole of the above-described signal processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as floppy disks, magnetic tapes, hard disk drives, etc.), optical magnetic storage media (e.g. magneto-optical disks), CD-ROM (Read Only Memory), CD-R , CD-R/W, DVD-ROM (Digital Versatile Disc Read Only Memory), DVD-R (DVD Recordable)), DVD-R DL (DVD-R Dual Layer)), DVD-RW (DVD ReWritable)), DVD-RAM), DVD+R), DVR+R DL), DVD+RW), BD-R (Blu-ray (registered trademark) Disc Recordable)), BD-RE (Blu-ray (registered trademark) Disc Rewritable)), BD-ROM), and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire or optical fiber or a wireless communication line.

Although embodiments of the invention made by the present invention are described in the foregoing, the present invention is not restricted to the above-described embodiments, and various changes and modifications may be made without departing from the scope of the invention.

The present application is applicable to a sound localization device that localizes sound images by using transfer characteristics.

What is claimed is:

1. A filter generation device comprising:

a filter generation unit configured to generate a filter in accordance with transfer characteristics from left and right sound sources to left and right microphones based on sound pickup signals, the sound pickup signals being acquired by picking up, using the left and right microphones, a measurement signal output from the sound sources, wherein the filter generation unit includes a search unit configured to search for a direct sound arrival time by using a time at which an absolute value of an amplitude reaches its maximum in each of first transfer characteristics from the left sound source to the left microphone and second transfer characteristics from the right sound source to the right microphone, a determination unit configured to determine whether signs of amplitudes of the first and second transfer characteristics at the direct sound arrival time match, a correction unit configured to correct cutout timing of the first transfer characteristics or the second transfer characteristics when the signs of the amplitudes of the first and second transfer characteristics at the direct sound arrival time do not match, and a cutout unit configured to cut out the first transfer characteristics or the second transfer characteristics at the cutout timing corrected by the correction unit, and thereby generate the filter.

2. The filter generation device according to claim 1, wherein the search unit sets, as the direct sound arrival time, a time at which the transfer characteristics have a local maximum point before the time at which the absolute value of the amplitude reaches its maximum.

3. The filter generation device according to claim 2, wherein when the local maximum point does not exist before the time at which the absolute value of the amplitude reaches its maximum, the search unit sets, as the direct sound arrival time, the time at which the absolute value of the amplitude reaches its maximum.

4. The filter generation device according to claim 1, wherein the determination unit determines whether direct sound arrival times of the first and second transfer characteristics coincide, when the direct sound arrival times of the first and second transfer characteristics do not coincide, the correction unit corrects cutout timing, and when the signs of the amplitudes of the first and second transfer characteristics at the direct sound arrival time match and when the direct sound arrival times of the first and second transfer characteristics coincide, the correction unit does not correct the cutout timing.

5. The filter generation device according to claim 1, wherein the correction unit corrects the cutout timing based on correlation between the first transfer characteristics and the second transfer characteristics.

6. A filter generation method that generates a filter by using transfer characteristics between left and right sound sources and left and right microphones, the method comprising:

a search step of searching for a direct sound arrival time by using a time at which an absolute value of an amplitude reaches its maximum in each of first transfer characteristics from the left sound source to the left microphone and second transfer characteristics from the right sound source to the right microphone;

a determination step of determining whether signs of amplitudes of the first and second transfer characteristics at the direct sound arrival time match;

a correction step of correcting cutout timing of the first transfer characteristics or the second transfer characteristics when the signs of the amplitudes of the first and second transfer characteristics at the direct sound arrival time do not match; and a step of cutting out the first transfer characteristics or the second transfer characteristics at the corrected cutout timing and thereby generating the filter.

7. The filter generation method according to claim 6, wherein the search step sets, as the direct sound arrival time, a time at which the transfer characteristics have a local maximum point before the time at which the absolute value of the amplitude reaches its maximum.

8. The filter generation method according to claim 7, wherein when the local maximum point does not exist before the time at which the absolute value of the amplitude reaches its maximum, the search step sets, as the direct sound arrival time, the time at which the absolute value of the amplitude reaches its maximum.

9. The filter generation method according to claim 6, wherein the determination step determines whether direct sound arrival times of the first and second transfer characteristics coincide, when the direct sound arrival times of the first and second transfer characteristics do not coincide, the cutout timing is corrected, and when the signs of the amplitudes of the first and second transfer characteristics at the direct sound arrival time match and when the direct sound arrival times of the first and second transfer characteristics coincide, the cutout timing is not corrected.

10. The filter generation method according to claim 6, wherein the correction step corrects the cutout timing based on correlation between the first transfer characteristics and the second transfer characteristics.

11. A sound localization method comprising:

a step of generating a filter by the filter generation method according to claim 6; and a step of convolving the filter to a reproduced signal.

* * * * *